United States Patent [19]

Petter

[11] Patent Number: 5,075,647

[45] Date of Patent: Dec. 24, 1991

[54] PLANAR SLOT COUPLED MICROWAVE HYBRID

[75] Inventor: Jeffrey K. Petter, Williston, Vt.

[73] Assignee: Universities Research Association, Inc., Washington, D.C.

[21] Appl. No.: 524,638

[22] Filed: May 16, 1990

[51] Int. Cl.[5] ..... H01P 5/20

[52] U.S. Cl. ..... 333/121; 333/246

[58] Field of Search ..... 333/116, 117, 120, 121, 333/238, 246; 455/327

[56] References Cited

U.S. PATENT DOCUMENTS

| | | | |
|---|---|---|---|
| 2,976,499 | 3/1961 | Sferrazza . | |
| 3,205,339 | 9/1965 | White . | |
| 3,422,377 | 1/1969 | Vient . | |
| 3,443,248 | 5/1969 | Broderick . | |
| 3,696,433 | 10/1972 | Killion et al. | 343/770 |
| 3,713,165 | 1/1973 | Lagerlof et al. | 343/771 |
| 3,715,689 | 2/1973 | Laughlin . | |
| 3,747,026 | 7/1973 | Covill . | |
| 3,815,055 | 6/1974 | Plunk et al. . | |
| 3,842,360 | 10/1974 | Dickens | 333/238 X |
| 3,863,181 | 1/1975 | Glance et al. . | |
| 3,886,500 | 5/1975 | Baril et al. | 333/121 |
| 3,946,339 | 3/1976 | Oltman, Jr. et al. | 333/121 |
| 3,955,156 | 5/1976 | Fleming . | |
| 4,129,839 | 12/1978 | Galani et al. . | |
| 4,135,170 | 1/1979 | Baril et al. | 333/26 |
| 4,139,827 | 2/1979 | Russell . | |
| 4,328,478 | 5/1982 | Murata et al. | 338/35 |
| 4,383,227 | 5/1983 | de Ronde | 333/121 |
| 4,463,326 | 7/1984 | Hom | 333/128 |
| 4,485,362 | 11/1984 | Campi et al. | 333/128 |
| 4,490,695 | 12/1984 | de Ronde | 333/128 |
| 4,547,745 | 10/1985 | Freitag | 330/286 |
| 4,583,061 | 4/1986 | O'Shea | 333/116 |
| 4,591,812 | 5/1986 | Stegens et al. | 333/116 |
| 4,595,891 | 6/1986 | Cronauer | 333/127 |
| 4,644,302 | 2/1987 | Harris et al. | 333/125 |
| 4,799,031 | 1/1989 | Lang et al. | 333/22 R |
| 4,952,895 | 8/1990 | Quan | 333/121 |

FOREIGN PATENT DOCUMENTS

| | | | |
|---|---|---|---|
| 101642 | 8/1979 | Japan | 333/121 |

OTHER PUBLICATIONS

Aikawa et al., *A New MIC Magic-T Using Coupled Slot Lines*, IEEE Trans. on MTT, vol. MTT-28, No. 6, Jun. 1980, pp. 523-528.

Aikawa et al., "A New MIC Magic-T Using Coupled Slot Lines", Jun. 1980, (IEEE, vol. MTT-28, No. 6).

Ogawa et al., "MIC Power Dividers Using Coupled Microstrip-Slot Lines Two-Sided MIC Power Dividers", Nov. 1985, (IEEE, vol. MTT-33, No. 11).

Schuppert, "Microstrip/Slotline Transitions: Modeling and Experimental Investigation", Aug. 1988, (IEEE, vol. MTT-36, No. 8).

de Ronde, "A New Class of Microstrip Directional Couplers", (Philips Research Laboratories, Netherlands), Unknown.

*Primary Examiner*—Paul Gensler

*Attorney, Agent, or Firm*—Neuman, Williams, Anderson & Olson

[57] ABSTRACT

A symmetrical 180° microwave hybrid is constructed by opening a slot line in a ground plane below a conducting strip disposed on a dielectric substrate, creating a slot coupled conductor. Difference signals propagating on the slot coupled conductor are isolated on the slot line leaving sum signals to propagate on the microstrip. The difference signal is coupled from the slot line onto a second microstrip line for transmission to a desired location. The microstrip branches in a symmetrical fashion to provide the input/output ports of the 180° hybrid. The symmetry of the device provides for balance and isolation between sum and difference signals, and provides an advantageous balance between the power handling capabilities and the bandwidth of the device.

6 Claims, 3 Drawing Sheets

PLANAR SLOT COUPLED MICROWAVE HYBRID

BACKGROUND OF THE INVENTION

1. Field of the Invention

The invention relates to planar broad bandwidth devices for propagating microwave energy. More particularly the invention relates to symmetrical 180° hybrids that exhibit nearly perfect amplitude and phase balance as well as very high isolation between the sum and the difference ports at all frequencies.

2. Description of the Prior Art

Microwave propagation devices are used on a vaiety of applications, including electronic counter measures, as well as in applications such as communications and stochastic cooling for particle accelerators. The requirements for microwave propagation devices differ from application to application. For example, in many communications applications, only a narrow band of frequencies are utilized and only narrow bandwidth devices are therefore necessary. In the other applications broad bandwidth devices are desirable to enable to use of signals having a wider range of frequencies.

Important aspects of the invention relate to the operation of microwave hybrid devices. Such devices are referred to by several terms in the literature including: Transverse Electromagnetic ("TEM") hybrids; 180° hybrids; magic tees; 180° couplers; TEM magic tees; and rat race hybrids. These devices will be generally referred to herein as 180° hybrids, a 180° degree hybrid being generally defined as being a four port device that for a particular frequency band exhibits certain properties to a specified accuracy. The four ports will be referred to throughout this specification as the sum port, the difference port, a first port and a second port. The characteristic properties are stated as follows:

1. A signal applied to the sum port will split to provide equal in-phase signals at the first and second ports with no signal at the difference port;

2. A signal applied to the difference port will split to provide equal signals 180° out of phase at first and second ports with no signal at the sum port;

3. A first signal applied to the first port and a second signal applied to the second port will provide signals at the sum and difference ports that represent the sum of the first and second signals and the difference of the first and second signals respectively;

4. The first and second ports are isolated from one another.

In order to meet operational requirements, 180° hybrids need to exhibit these characteristics. The range of frequencies over which the device exhibits the required characteristics to within acceptable bounds defines its operational band. If $f_1$ is defined as the lower bound of the operational band and $f_2$ as the upper bound then the width can be defined as $f_2-f_1$ and the relative bandwidth as $(f_2-f_1)/f_1$. An octave bandwidth is achieved when $f_2=10f_1$. The greater the operational band, the greater the usefulness of 180° hybrids in broad band applications.

The operational bands of prior art 180° hybrids vary with their construction. Consider one commonly used 180° hybrid known as the common rat race or ring hybrid. The impedances at the two output ports of this device are only identical at one or two frequencies at best and the signals at the first and second ports when driven at the sum or difference port are only perfectly balanced at one or two frequencies. Modified ring hybrids have been created with improved perfermance. None, however, make the bandwidth larger than about half an octave.

A further 180° hybrid not commercially available that is operational for bandwidths of about an octave and uses coupled slot lines is described by Aikawa and Ogawa In IEEE Trans. on MTT, Vol. 28, No. 6 (June 1980). this type of device should exhibit nearly perfect amplitude and phase balance over octave bandwidths. the isolation between the sum and difference ports should also be quite high for these bandwidths. This type of device is not, however, operational over bandwidths greatly in excess of one octave.

In applications in which wider bandwidths and/or higher performance are required a 90° hybrid followed by a Schiffman phase shifter is generally utilized to provide a 180° hybrid. This type of device is most commonly constructed in strip line but it is also possible for it to be constructed in microstrip. For highest performance the strip line used in this type of device is constructed on a low permeability dielectric such as Teflon/glass and multiple stage offset couple strip lines are used to make the 90° hybrid and the Schiffman phase shifter. In order to achieve good performance in this type of device over wide bandwidths, considerable precision in construction is required. The requisite degree of precision is difficult to achieve for very broad bandwidths and the construction results in the utilization of quite narrow metal foil lines. The narrow lines put limits on the amount of power that can be put through such devices. This type of device works quite well over octave bandwidths and although devices have been made with bandwidths of 2 octaves the manufacture of devices with broader bandwidths than these is restricted by the previously mentioned construction limitations.

The "Tapered Asymmetric Microstrip Magic Tee" described by M.H. Araim and N.W. Spencer in IEEE Trans. on MTT Vol. 23 No. 12(Dec 1975) describes a 180° hybrid that can function over bandwidths in excess of a decade. The device is constructed using a cascade of two −8.39dB asymmetric microstrip couples. The asymmetric construction of the device means that it does not exhibit perfect amplitude and phase balance at all frequencies. The power handling capabilities of this device are also limited.

OBJECTS OF THE INVENTION

Accordingly it is an object of this invention to provide an improved 180° microwave hybrid.

It is a specific object of this invention to provide a broad bandwidth 180° hybrid.

It is another object of this invention to provide 180° hybrid that provides for good isolation between the sum and difference signals.

It is a further object of this invention to provide a 180 ° hybrid which provides good amplitude and phase balance for the whole operational bandwidth and good power handling capablitities.

Other objects, advantages and features of this invention will become apparent on reading the following description and appended claims, and upon reference to the accompanying drawings.

SUMMARY OF THE INVENTION

The present invention addresses many of the deficiencies in prior art 180° hybrids. In most 180° hybrids a designer must trade between various attributes of a device such as bandwidth, imput and output impedance matching, amplitude and phase balancing, isolation between the output and input ports, and power handling capabilities. In most 180° hybrids all these parameters are coupled in complex ways to the adjustable parameters. of the device, a series of structural dimensions. This complex relationship between parameters only allows phase and amplitude balancing and perfect isolation between the sum and difference ports at discrete frequencies. It is recognized that the complexity of the relationships between parameters is due in part to the non-symmetrical nature of many 180° hybrids.

All commercially available 180° degree hybrids known to the inventor which have been constructed in a planar or multiplanar construction are not symmetrical and therefore suffer because they do not inherently have good balance between output ports or good isolation over broad bands. This lack of symmetry increases the number of parameters that must be adjusted in order to keep performance characteristics within acceptable bounds over the operational bands. Only the slot line devices described by Aikawa and Ogawa are symmetrical. It is recognized, however, that the use made of slot lines in these devices also places restrictions on their applications. This is due in part to the fact that it is difficult to match the sum and difference mode velocities in coupled slot line devices to the degree necessary for ideal performance over bandwidths in excess of one octave. The range of impedances achievable at the four ports is also resticted because of the use of slot lines.

The present invention provides a symmetrical 180° hybrid that inherently provides balanced signals at the output ports isolated one from the other and substantially avoids the problems with velocity matching of coupled slot modes. The 180° hybrid uses a symmetrical slot coupled microstrip line to isolate sum and difference signals. The design of the device theoretically allows a 180° hybrid with operational bands of up to 100–1000% to be achieved.

In accordance with one embodiment of the present invention a symmetrical 180° microwave hybrid is constructed by opening a slot line in a ground plane below a conducting strip disposed on a dielectric substate to create a coupled conductor that isolates the difference mode on the slot line leaving the sum mode to propagate on the microstrip. The difference mode is then coupled from the slot line onto a second microstrip line for transmission to a desired location. The conducting strip branches in a symmetrical arrangement to provide the first and second ports of the 180° hybrid.

In this 180° hybrid the amplitude and phase balance in both the sum and difference ports are theoretically perfect. As long as the symmetry of the device is not disturbed the amplitude and phase balance are maintained and the device can be designed to provide other desirable characteristics. In practice the degree of amplitude and phase balance is only limited by the precision with which the 180° hybrid can be made physically symmetrical. The symmetry of the device includes the positioning of the slot line, which must fall along the center line of the conducting strip, as well as the elctrical symmetry of the device.

As well as near perfect amplitude and phase balance, the symmetry of the 180° hybrid of this invention also provides theoretically perfect isolation between the sum and difference ports. In fact with the arrangement of this invention, the only design feature that remains to be set is the matching between the four ports. Once this matching is achieved all the required criteria for good operation of a broad bandwidth device, apart from power handling capability, are satisfied.

By utilizing slot coupled microstrip lines, the device can also exhibit good power handling capabilities. The choice of substrate amongst other things determines the power handling capabiliy of the device. With prudent choice of substrate material the power handling of this device is very good because it does not require the use of very narrow lines as do other broad bandwidth 180° hybrids. This device is therefore extremely useful in applicaitons in which broad bandwidths and, but not necessarily, high power, are desirable.

BRIEF DESCRIPTION OF THE DRAWINGS

For a more complete understanding of this invention, reference should now be made to the embodiment illustrated in greater detail in the accompanying drawings and describe by way of example only. In the drawings.

DETAILED DESCRIPTION OF THE DRAWINGS

Figure 1:
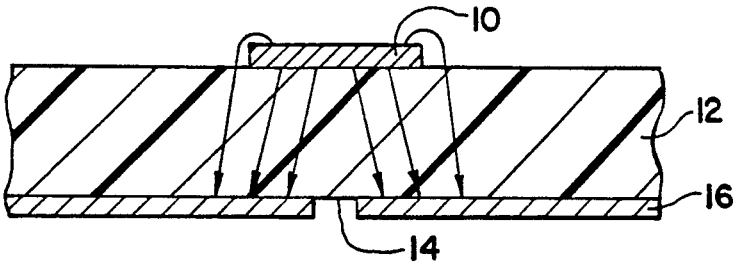
FIG. 1 is a section through a slot coupled microstrip showing electric field lines in propagation of the even mode.
Figure 2:
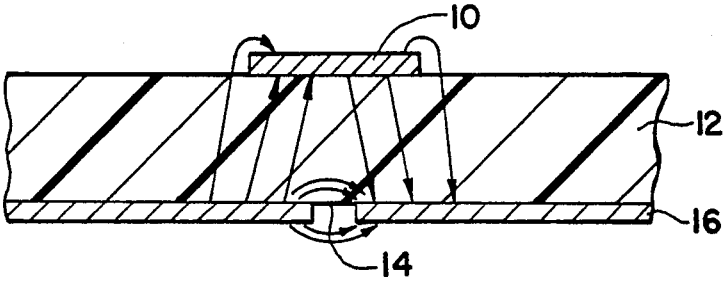
FIG. 2 is a section through the slot coupled microstrip of FIG. 1 showing the field lines in propagation of the odd mode.

The 180° hybrid of the invention uses a symmetrical slot coupled microstrip line to isolate the sum and difference signals. For the purposes of discussing the operaiton of this invention, and modes of signal propagation in a slot coupled microstrip will be termed even and odd modes. The field lines of these modes are shown in FIGS. 1 and 2 for a microstrip 10 situated on a dielectric substrate 12 above a slot 14 cut in a ground plane 16. The even mode propagates the sum signal and the odd mode propagates the difference signal. The even mode is the mode which is very similar to that which propagates in a microstrip. Electric field lines for this mode are shown in FIG. 1. The odd mode is that which travels mostly in the slot line. Electric field lines for this mode are shown in FIG. 2.

Opening an elongated slot in a ground plane directly beneath and parallel to a microstrip conductor allows operation in a manner similar to that obtained with a pair of coupled microstrips. The odd and even mode impedances of the structure are consequently also very similar to those of a coupled microstrip. Impedance and other parameters for a pair of coupled microstrips can, therefore, be used as an approximation for the parameters of the slot coupled microstrip.

Figure 3:
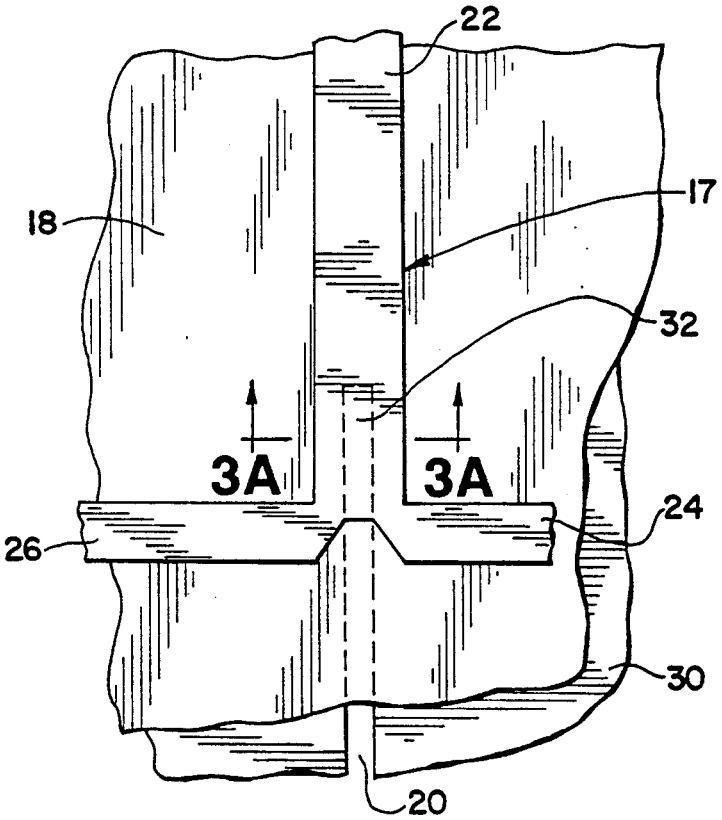
FIG. 3 is a top view of a three-way junction between microstrip liens one of which is coupled to a slotline.
Figure 3A:
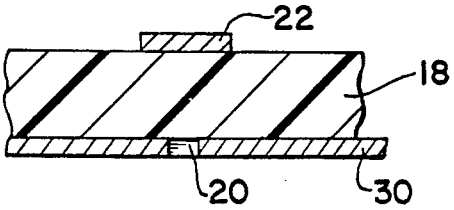
FIG. 3A is a section through the junction of FIG. 3.

To aid in the understanding of the invention the simple junction shown in FIGS. 3 and 3A will be discussed. The structure of FIG. 3 is the simplest conceivable configuration of this invention and exhibits all the basic characteristics of a symmetical 180° hybrid. a microstrip layout 17 disposed on the top side of the substrate 18 (FIG. 2) is shown in solid lines and a slot line 20 etched in a ground plane on the opposite side of the substrate 18 is shown in broken lines. This junction has mirror symmetry about a longitudinal center line of the slot line 20. Michrostrip lines 22, 24 and 26 are joined at a common junction. The slot line 20 is etched in a ground plane 30 and runs exactly in the center of microstrip 22. The section where the slot line 20 runs under microstrip 22 creates a slot coupled microstrip section having characteristics as described in connection with FIGS. 1 and 2.

By using the microstrip line 22 as an input port, the even mode of the slot coupled microstrip line is excited. This mode will excite signals on microstrips 24 and 26 which are equal in amplitude and have identical phase. Conversely, if two signals in-phase and of equal amplitude are input to microstrip line 24 and 26, the even mode of the slot coupled microstrips will be excited and a signal will be excited on microstrip line 22. In this case only the even mode is excited and no odd mode signal will propagate in the slot line 20. In this manner a sum signal is propagated.

By using slot line 20 as an input the odd mode of the slot coupled microstrip will be excited. This mode excites signals on microstrip liens 24 and 26 which are equal in amplitude and opposite in phase. The portion of the conductive ground plane 30 at the end of slot line 20 provides a short 32 which shorts out the odd mode at that point and causes it to reflect back along slot line 20. Consequently, there is no signal on microstrip line 22. As with excitation of the even mode, the converse operation with, equal amplitude opposite phase signals on microstrip lines 24 and 26, also causes an odd mode to be propagated, exciting a signal in the slot line 20 and no signal in line 22. In this manner a difference signal is propagated.

With proper matching, the structure of FIG. 3 can operate as a 180° hybrid with microstrip line 22 as the sum port and the slot line 20 as the difference port. Microstrips 24 and 26 are the first and second ports. Because of the simplicity of this device, the impedance of the four ports can, however, only be matched over a narrow frequency band. Nevertheless, the isolation between the sum and difference ports (microstrip 22 and slotline 20) is practically infinite at all frequencies because of the symmetry of the device and the sum and difference mode amplitude and phase balance is at least as perfect as the precision of the mirror symmetry of the device.

Figure 4:
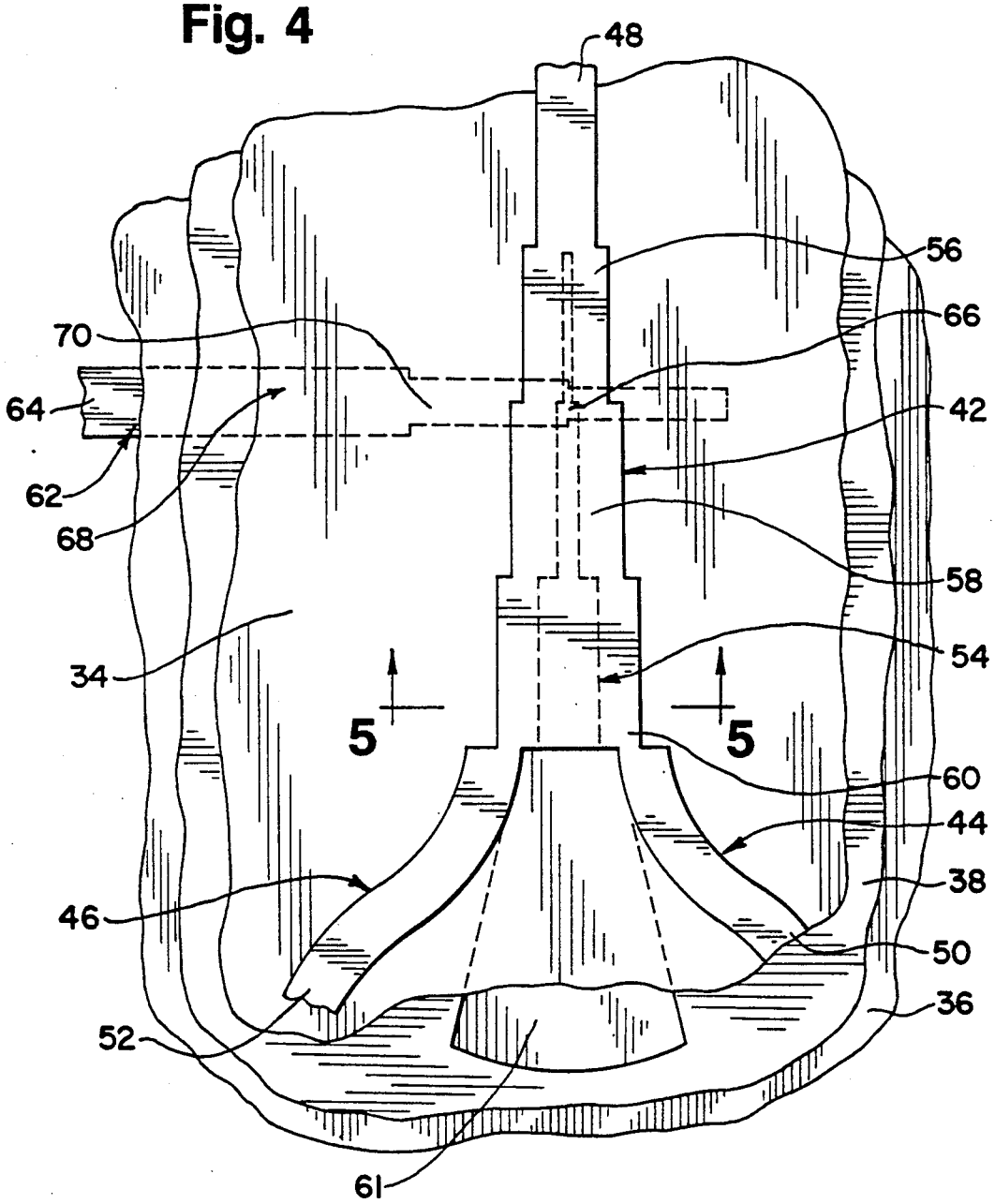
FIG. 4 is top view of a microwave printed circuit showing a 180° hybrid of this invention with microstrip on the top substrate depicted in solid lines, slotlines depicted in broken lines and microstrip on the bottom substrate depicted in dashed lines.
Figure 5:
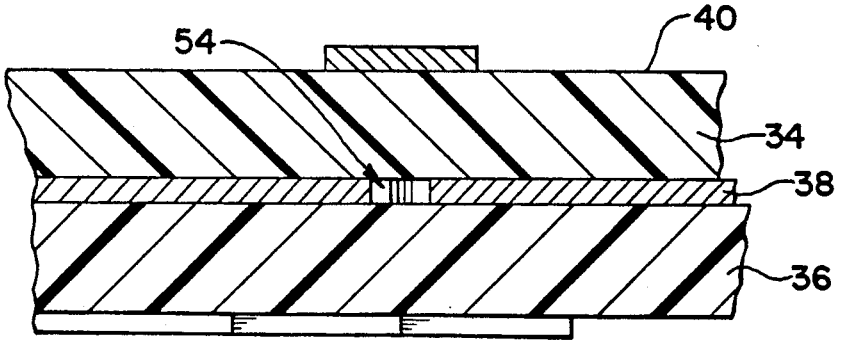
FIG. 5 is a section through the 180° hybrid of FIG. 4 at line 5—5 showing the relative positions of the microstrip and slot lines.

Turning now to FIG. 4, a more versatile embodiment of the 180° hybrid microwave device of this invention can be seen. The device has two dielectric substrates 34, 36. These are disposed one on either side of a ground plane 38. Disposed on the exposed side 40 of the first dielectric substrate 34 are three microstrip sections 42, 44, 46 which may preferably have an impedance of 50 ohms, for example which are joined at a common junction and terminating at a sum port 48 and first and second ports 50 and 52 respectively. A slot line 54 is cut in the ground plane 38 and extends parallel to the microstrip line 42 bisecting it and creating three slot coupled microstrip line sections 56, 58, and 60. These sections are stepped and are used as quarter wave impedance matching steps. Any number of such steps can be used to provide a desired bandwidth, as is well known in the art and described in "Optimum Design of Stepped Transmission-Wire Transformers" by S. B. Cohn IRE Trans, MTT, or 19 TT-3 Apr. 1955, pp. 16-21, incorporated herein by reference. The slot line 54 ends in a slot line open circuit 61. A microstrip line 62 which may have a characteristic impedance of 50 ohms, for example, terminates at a difference port 64 and is located on the exposed side 48 of the second dielectric substrate 36. This microstrip line 62 extends perpendicular to the slot 54 and is coupled to the slot line 54 at a transition point 66.

As is well known in the art, 180° hybrids can be used in a variety of ways for a variety of applications. A pair of signals can be fed simultaneously into the first and second ports 50 and 52 of the 180° hybrid on microstrip lines 44 and 46 respectively to provide sum and difference signals at the sum and difference ports 48 and 64 respectively, as described previously in relation to the configuration of FIG. 3. The sum signal will propagate in the even mode of the slot coupled microstrip lines 60, 58 and 56 of the microstrip line 42 and out at the sum port 48. If the sum mode impedances are matched in the manner well known in the art and described in detail in the IEEE Transactions on Microwave Theory And Techniques, Vol 28, No. 6 mentioned earlier incorporated herein by reference, all the sum mode energy will be transferred to the sum port 48 and no sum mode energy will be reflected back to the first and second ports 50, 52. The sum mode impedances matching is achieved by prudent choice of the matching steps of the slot coupled microstrip lines 56, 58, 60 in order to match the impedance of microstrip lines 44 and 46.

The difference mode signal excited by signals fed simultaneously into the first and second ports 50, 52 will excite the odd mode of the slot coupled microstrip line sections 56, 58 and 60 of the microstrip line 42 and the slot line open circuit 61. As shown, a slot extrusion of expanding width is provided to define one effective slot open circuit 61 which will reflect the energy back to the slot line 54. With proper impedance matching, the difference mode signal propagates in the odd mode of the slot coupled microstrip lines 60 and 58 to a transition 66 where it is coupled to microstrip 62 having two impedance matching quarter wavelength steps 68, 70, that terminates at the difference port 64. Although the impedances in the illustrated embodiment have been matched through a series of quarter wavelength matching steps, tapered slot lines and microstrip lines can be used in alternative embodiments to accomplish the same results.

The transition is very similar to a microstrip to slot line transition and can be made in a number of ways. The quarter wave length overlap, providing a virtual short circuit in the microstrip and a virtual open circuit in the slot line, is preferred because it needs no through holes or shorting ribbons that might reduce the power handling capabilities of the device. Alternative configurations for transition 66 to that shown in FIG. 4 can be used. Some examples of such transitions can be found in an article entitled "Microstrip/Slotline Transitions: Modeling and Experimental Investigation" by Bernard Schuppert in IEEE Transactions on Microwave Theory And Techniques, Vol 36, No. 8 Aug. 1988, incorporated herein by reference. This reference also provides teaching regarding open and short circuits.

The impedance matching for the difference mode is somewhat more complicated than that for the sum mode. The IEEE Transactions on Microwave Theory And Techniques, Vol 28, No. 6 provides information regarding difference mode impedance matching of a symmetric device. To a first order approximation, the slot line open circuit 61 and the transition 66 can be ignored if they are well designed. It is important therefore that the open circuit is as near perfect an open circuit as possible and that the transition is as near perfect a coupling between the slot line and microstrip line as possible. If, however, the characteristics of the slot line open circuit 61 and the transition 66 are known, a computer simulation such as that using the 'Touchstone' software package of the company EESof can be used to optimize the values of the odd mode impedances of slot coupled microstrip lines 56, 58, 60 and microstrip line 62. With the sum and difference impedances being matched, the device is operative as an extremely broad bandwidth 180° hybrid.

By way of illustration only the dimensions and materials used to provide the 180° hybrid of FIG. 4 designed to have a bandwidth of 4–8 GHz, balance better than ±0.25 dB and ±5 degrees in both sum and difference modes, power capability in excess of 100 W at any port, and having all VSWR's better than 1.15 and $Z_0=50\Omega$. It will of course be clear to those in the art that using the techniques mentioned above an almost infinite number of other devices, designed to have different characteristics are possible.

For example the dielectric substrates chosen for the top substrate 24 of the device of FIG. 1 may be, for example, RT Duroid 6010.5, 50 mils thick, the microstrip lines 42, 44, 46 may be, for example, formed from 1 oz. copper and the top substrate may have a permittivity of 10.5, while the bottom substrate 36 may be made from RT Duroid 5880 20 mils thick with the microstrip 62 formed from 1 oz. copper and the bottom substrate 36 may have a permittivity of 2.2. In this example, the substrates are plated to at least 1.15 mils and the plating is etched to form the microstrip configurations.

Also, in this example, the microstrip lines 42, 44, 46 at ports 48, 50, 52 are 45.5 mils wide and each has an impedance of 50 ohms. The microstrip line 62 at the difference port 64 is 89.9 mils wide and the two stepped quarter wave length sections 68, 70 are 359 mils long 42.5 mils wide and 305 mils long and 25.5 mils wide respectively. The slot open circuit 61 is 120 mils in length.

The dimensions for the slot coupled microstrip sections 56, 58, 60 are as follows:

| | Length of Section | Width of Strip | Width of Slot |
|---|---|---|---|
| 56 | 140 mils | 67.5 mils | 42.5 mils |
| 58 | 135 mils | 88.5 mils | 37.5 mils |
| 60 | 135 mils | 166.5 mils | 109.5 mils |

Figure 6:
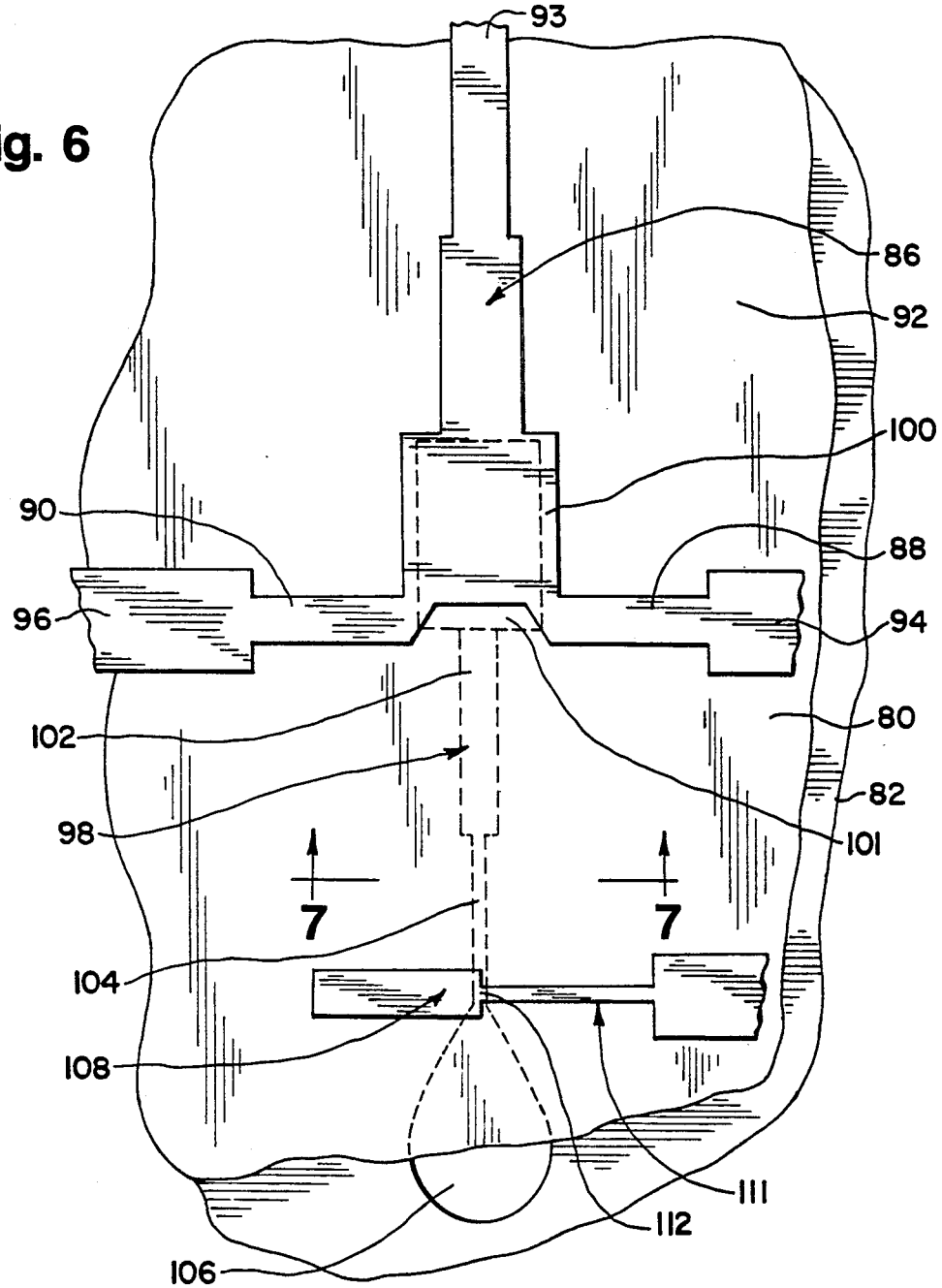
FIG. 6 is a top view of a circuit showing an alternative embodiment of this invention using the same line conventions as FIG. 4.
Figure 7:
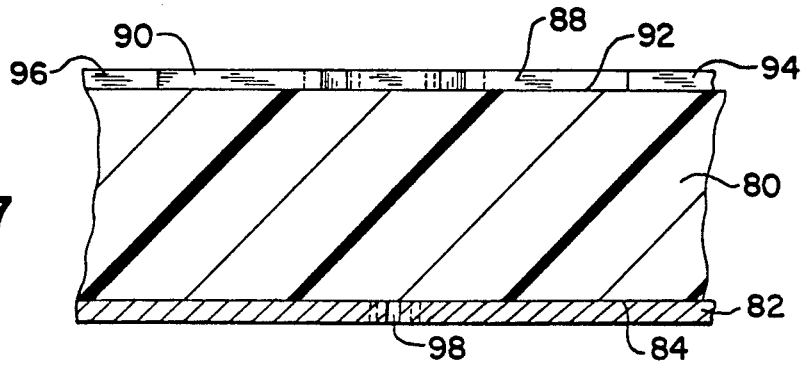
FIG. 7 is a section through the 180° hybrid of FIG. 6 at line 7—7.

FIGS. 6 and 7 show an alternative embodiment of the present invention. For a slight compromise in performance this device has the advantage of needing only one substrate. The dielectric substrate 80 has a ground plane 82 on a first face 84 and three microstrip lines 86, 88, 90 joined at a common junction situated on the opposite face of the substrate. The three microstrip lines 86, 88, 90 are similar to those of the previous embodiment. The microstrip lines 86, 88, 90 terminate in a sum port 93, a first port, 94 and a second port, 96 respectively. A slot line 98 is cut in the ground plane 82 and extends parallel to the microstrip line 86 bisecting it creating a slot coupled microstrip line section 100. The slot line 98 extends beyond the slot coupled microstrip line 86 forming two impedance matching sections 102, 104. The two slot line sections 102, 104 are used to transform the impedance presented by the junction 101 at a transition point 112 to one easily matched to a microstrip line. As with the previous embodiment the stepped increase in slot line and microstrip line widths could be replaced by gradually tapered slot and microstrip lines. The microstrip slot line transition 112 is achieved here using a slot line open circuit 106 and a microstrip stub 108. This transition point 112 transfers the signal between the slot line 104 and a microstrip line 111.

One major limitation is placed on the performance of this device by the degree to which the odd mode of the slot coupled microstrip line 100 can be made to approximate an open circuit. To first order, the coupled microstrip line 100 should be ¼ wavelength long at mid band and as wide as possible. The width is limited, however, to less than ¼ wavelength at the highest frequency of concern because for higher frequencies, those with ¼ wavelengths less than the width of the slot coupled section, the structure will multimode causing unwanted behaviour.

In a similar manner to that described previously, any sum signal will propagate in the even mode and any difference signal in the odd mode of the slot coupled section 100. With the sum mode impedances matched all the sum mode energy is transferred to the sum port 93 and none will be reflected back to the first and second ports 94, 96. The approximation to an open circuit achieved by the odd mode of the slot coupled section, causes the difference signal to be reflected back along the slot line sections 102, 104. With proper impedance matching designed in accordance with the discussion above, the difference mode signal will propagate in the slot line sections 102, 104. The slot line is terminated at the virtual open circuit 106 and the microstrip line 108 overlaps the slot line for one quarter wavelength to provide a virtual short circuit to provide the transition point 112 between the slot line 98 and the fourth microstrip line 111 similar to that described previously.

The first and second ports 94 and 96 are symmetric about the coupled microstrip slot line and positioned to provide sufficient room for the microstrip line 108 to be placed on the same face of the substrate as the other three microstrip sections 86, 88, 90. This location is purely one of convenience and the microstrip line 108 could equally well have been located on a second substrate disposed on the other side of the ground plane.

The sum and difference impedances of the device are matched in a manner similar to that described in the previous embodiment and again, at 180° hybrid is provided that in theory can operate to bandwidths up to 100–1000%, if dispersion and attenuation can otherwise be tolerated. The device can also be used as high power splitter or combiner as described above.

While two preferred embodiments of this invention are illustrated, it will be understood, of course that the invention is not limited to these embodiments. Those skilled in the art to which the invention pertains may make modifications and other embodiments employing the principles of the invention, particularly upon considering the foregoing teachings.

What is claimed is:

1. An apparatus for propagating microwave energy comprising:

a dielectric substrate having first and second opposed faces;

a first conducting member disposed on said first face of said dielectric substrate including a first portion having a longitudinal center line and terminating at a first end in a first port and having a second end, and second and third portions connected to said second end of said first portion extending away from said center line to terminate at second and third ports respectively; and a ground plane disposed on said second face of said dielectric substrate, said ground plane having a gap therein defining an elongated slot parallel to and opposite said first portion and aligned with said center line for creating a slot coupled section, and arranged for energy propagation between said slot coupled section and a fourth port, wherein said ground plane has a first side disposed on said second face of said dielectric surface and a second side opposite said first side, and further comprising a second dielectric substrate having an inner face and outer face disposed with said inner face on said second side of said ground plane and a second conducting strip disposed on said outer face terminating at said fourth port and arranged for said energy propagation between a transition portion of said elongated slot and said fourth port.

2. The apparatus of claim 1 wherein said elongated slot and said second conducting strip are disposed in orthogonal relation.

3. An apparatus for propagating microwave energy comprising:

a first dielectric substrate having first and second opposed faces;

a first conducting member disposed on said first face of said dielectric substrate including a first portion having a longitudinal center line terminating at a first end in a first port and having a second end, and second and third portions connected to said second end of said first portion extending away from said center line to terminate at second and third ports respectively;

a ground plane having a first surface and a second surface, said first surface disposed on said second face of said dielectric substrate, said ground plane having a gap therein defining an elongated slot parallel to and opposite said first portion and aligned with said center line for creating a slot coupled section, and arranged for energy propagation between said slot coupled section and a fourth port;

a second dielectric substrate having a first face disposed on the second surface of said ground plane; and a fourth conducting strip disposed on a second face of said second dielectric substrate opposite said first face, terminating at a first end at said fouth port and arranged for said energy propagation between a transition portion of said elongated slot and said fourth port.

4. The apparatus of claim 3 wherein said first conducting member is mirror symmetric about said center line.

5. The apparatus of claim 3 wherein said elongated slot extends beyond said first portion and terminates at a first end at a virtual open circuit.

6. The apparatus of claim 3 wherein said second conducting strip terminates at a first end beyond said transition portion in a virtual short.

* * * * *